US006357762B1

(12) United States Patent
Beeck

(10) Patent No.: US 6,357,762 B1
(45) Date of Patent: Mar. 19, 2002

(54) SEALING ELEMENT FOR MELT CHANNELS

(75) Inventor: Heinz-Dieter Beeck, Frankfurt am Main (DE)

(73) Assignee: Zimmer Aktiengesellschaft, Frankfurt am Main (DE)

( * ) Notice: Subject to any disclaimer, the term of this patent is extended or adjusted under 35 U.S.C. 154(b) by 0 days.

(21) Appl. No.: 09/295,611

(22) Filed: Apr. 20, 1999

(30) Foreign Application Priority Data

May 13, 1998 (DE) ..... 198 21 406

(51) Int. Cl.[7] ..... F16J 15/08

(52) U.S. Cl. ..... 277/608; 277/627; 277/641; 277/650; 277/939; 425/72.2; 425/378.2; 425/192.5; 425/DIG. 49

(58) Field of Search ..... 277/608, 626, 277/627, 630, 650, 641, 939; 425/72.2, 378.2, 192.5, DIG. 49; 264/178 F

(56) References Cited

U.S. PATENT DOCUMENTS 3,407,437 A * 10/1968 Lenk
3,480,995 A * 12/1969 Lenk
3,516,119 A * 6/1970 Keller
3,891,379 A * 6/1975 Lenk ..... 425/464
4,333,629 A * 6/1982 Roy ..... 249/119
4,494,921 A * 1/1985 Sowell ..... 425/198
4,648,826 A * 3/1987 Ogasawara et al. ..... 425/192 S
4,696,633 A * 9/1987 Lenk et al. ..... 425/192 S
5,354,529 A * 10/1994 Berger et al. ..... 264/176.1
5,387,097 A * 2/1995 Scheiber et al. ..... 425/382.2
5,605,626 A * 2/1997 Gneuss ..... 210/236
5,628,517 A * 5/1997 Jia
5,645,874 A * 7/1997 Osuna-Diaz ..... 425/549
5,720,995 A 2/1998 Gellert
5,792,493 A * 8/1998 Gellert ..... 425/567

* cited by examiner

*Primary Examiner*—Anthony Knight
*Assistant Examiner*—Alison K. Pickard
(74) *Attorney, Agent, or Firm*—McDonnell Boehnen Hulbert & Berghoff

(57) ABSTRACT

The invention provides a sealing element for spinning systems used for spinning polymer melts, wherein the sealing element seals the transition between a polymer melt conducting melt channel of a permanently mounted component and a melt channel of a removable, interchangeable component. The sealing element consists of a cylindrical and externally smooth hollow object with an axial bore for passage of the melt, which hollow object is inserted into a fitting socket hole in the interchangeable component and is made of a material with a higher thermal expansion coefficient than that of the surrounding material of the interchangeable component.

10 Claims, 1 Drawing Sheet

SEALING ELEMENT FOR MELT CHANNELS

BACKGROUND OF THE INVENTION

1. Field of the Invention

The invention relates to a sealing element for sealing the transition between the melt channel (which conducts a polymer melt) of a permanently mounted component into the melt channel of a removable, interchangeable component in spinning systems used for spinning polymer melts. Preferably, the permanently mounted component is a spinning beam and the interchangeable component is a nozzle adapter of a melt spinning system.

2. Summary of the Related Art

In spinning systems used for spinning polymer melts, adapters, or nozzle adapters are used to connect the heating container (also known as a spinning beam) and the individual spinning package so that each individual spinning package can be easily removed and replaced for cleaning purposes and for reassembly of the individual parts of the spinning package. Metal O-rings in face grooves are normally used to seal off the spinning channel running from the spinning beam to the adapter, so that spinning operation pressures ranging from a minimum of 80 to a maximum of 350 bar (depending on the polymer) at spinning temperatures ranging from more than 150° C. to no more than 320° C. do not result in leakage of the polymer melt. If the adapters themselves are replaced frequently, the countersurfaces must be made of crush-proof materials, e.g., in the form of welded-on stellite cladding, so as to guarantee the seal during longer periods of operation. The O-rings are glued into the face grooves to prevent them from falling out during assembly. Furthermore, these sealing rings, which are expensive, are only intended for single use and must be replaced whenever the adapter is replaced.

The frequency of adapter replacement is especially high during spinning processes that require that the melt be homogenized by a static mixer located as closely as possible to the spinning nozzle. In such cases, this mixer is usually installed in the adapter, as the process requires that it be frequently replaced or routinely cleaned.

The assembly problem associated with the above type of system is that the spinning system must be assembled when it is cold, i.e., at normal room temperature, while replacement of the adapter, with or without a mixer, must take place under hot operating conditions. The component being replaced, in this case the nozzle adapter, is removed while it is hot and is replaced by a cold, fresh component. This procedure applies not only to the aforementioned nozzle adapter, with or without a mixer, but applies more generally to all components that contain lines to conduct polymer melt and that are equipped with any additional parts that require frequent replacement.

A similar situation exists in injection molding technology, in which the thermal expansion coefficient of the construction material is used (e.g., U.S. Pat. No. 5,720,995). In this case, the space between the feed head and the spray head, which space fluctuates in response to temperature, is counterbalanced by a sliding connection piece whose short end is screwed into the feed head and whose long end is displaceably inserted into the bore of the spray head. The fit between the connection piece and the bore and the mating of material (a copper-beryllium alloy for the connection piece and normal steel for the spray head) is selected in such a way that displacement of the long connection piece can take place in the bore to counterbalance the variable space between the feed head and the spray head, even at operating temperatures. Only the narrow and long gap between the connection piece and the bore is used for sealing purposes. Naturally, there must be sufficient space between the long portion of the connection piece and the end of the bore so that the sliding and expansion motion can take place. This space, which represents an expansion of the normal melt channel up to the outside diameter of the connection piece, forms a so-called dead space in which the polymer cannot adequately replace itself. This undefined dwell time, which leads to the breakdown of the polymer, is highly detrimental to the spinning process. The presence of any leaks is also unwanted. Furthermore, assembly and disassembly can only take place when the equipment is in its cold condition, thus shortening usage time by the amount of time it takes the system to cool down.

SUMMARY OF THE INVENTION

The foregoing disadvantages of the prior art are addressed by the present invention, which provides a sealing element that allows for frequent component replacement under cost-effective and comfortable conditions, while simultaneously guaranteeing a secure seal.

This is accomplished according to the invention with a sealing element that comprises a cylindrical and externally smooth hollow object with an axial bore for passage of the melt, which object is inserted into a fitting socket hole in an interchangeable component and is made of a material with a higher thermal expansion coefficient than that of the surrounding material of the interchangeable component. The dimensions of the hollow object and the composition and physical characteristics of the material of which it is made are chosen relative to that of the socket hole such that at temperatures distinctly below the polymer melt temperature (preferably at room temperature) the hollow object slides easily into the socket hole, whereas a the polymer melt temperature the hollow object expands against the socket hole to form a tight fit.

DETAILED DESCRIPTION OF THE INVENTION

Figure 1:
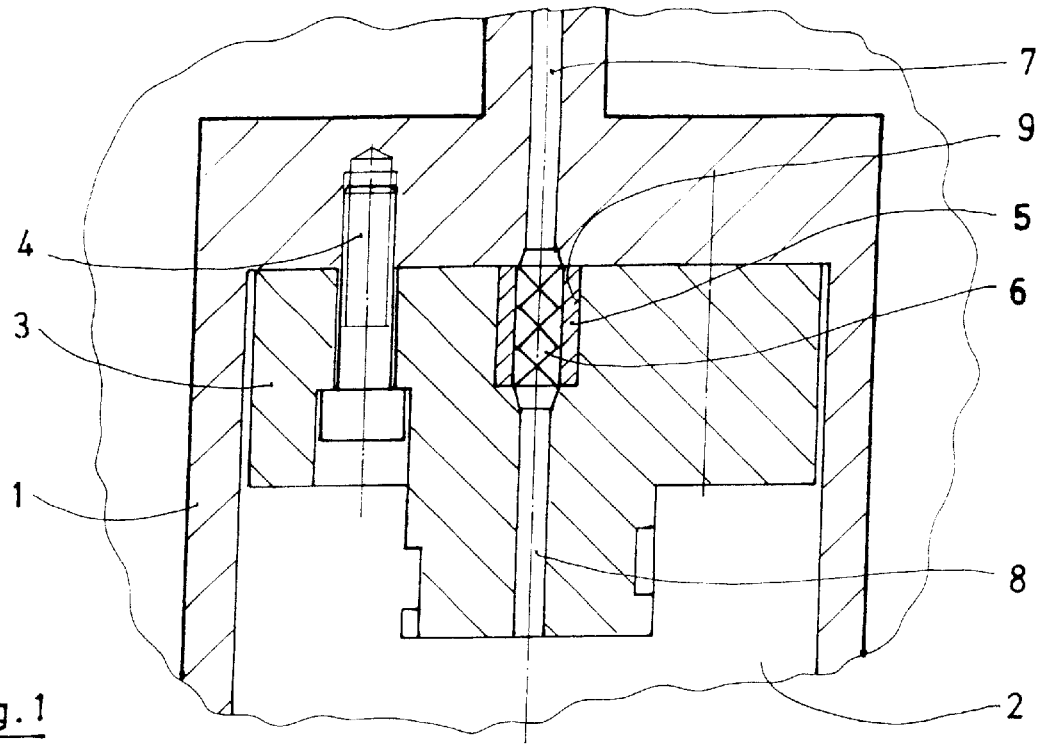
FIG. 1 depicts a nozzle adapter with a built-in static mixer and a spinning beam, as well as a sealing element according to the invention.

The present invention provides a sealing element to seal the junction between the melt channel of a permanently fixed component at its frontal surface and the melt channel of an interchangeable component (removably attached to the permanently fixed component) at its frontal surface.

According to the invention, a cylindrical and externally smooth hollow object with an axial bore for passage of the melt inserts into a fitting socket hole of the interchangeable component in such a way that it is flush with the frontal surface of the interchangeable component. The relative dimensions of the hollow object and the fitting socket hole are selected in such a way that the hollow object can easily slide into the fitting socket hole of the interchangeable component at normal room temperature. The hollow object is preferably installed completely within the interchangeable component, which is capable of being easily attached to and unattached from the permanently fixed component. Any protrusion of the hollow object into the opposing permanently fixed component is neither necessary nor desirable, as this would impede unattaching the interchangeable component from the permanently fixed component under hot conditions. The frontal (or contact) surfaces of the two components do not require any additional sealing grooves or other contrivances as sealing aids, but can instead be designed to be completely even and smooth.

The hollow object must consist of a material with higher thermal expansion coefficient than the material defining the fitting socket hole into which the hollow object is inserted. The axial and radial sealing effect occurs after the interchangeable component and the hollow object have reached operating temperature. Sealing is achieved solely as a result of the differences in thermal expansion of the parts that have been joined together. This means that sealing does not occur until the temperature approaches the melting point of the polymer. Because of its volumetric growth, the hollow object is then positioned in the fitting socket in an absolutely fixed and gap-free manner, thereby completely sealing off the frontal surfaces. After a cooling period, the components can once again be easily removed at normal ambient temperatures. As the hollow object is only installed into the interchangeable component, this component can also be removed from the permanently installed component while hot, and can then be replaced by a cold component containing a hollow object whose front end is flush with the sealing surface.

In view of the foregoing, in a general embodiment, the invention comprises a sealing element for sealing the transition between a polymer melt conducting melt channel of a permanently mounted component and the melt channel of a removable, interchangeable component, wherein the sealing element consists essentially of a cylindrical and externally smooth hollow object with an axial bore for passage of the melt that is inserted into a fitting socket hole in the interchangeable component and that is made of a material with a higher thermal expansion coefficient than that of the material of the fitting socket hole of the interchangeable component that surrounds the hollow object.

Although the sealing concept of varying thermal expansion described by the invention is especially well-suited for melt spinning systems, it is also suitable for other purposes, such as diameter adjustments in the melt line, or bifurcations and injector connections, and is especially advantageous for all applications in which melt-conducting parts that have been assembled while cold must also be disassembled while hot.

An especially preferred application consists of melt spinning systems with melt channels in which mixers must be installed as closely as possible to the spinning nozzle, as well as those in which mixers are to be installed in other parts of the melt line in such a way as to be easily accessible or quickly replaceable.

Static mixers are usually selected in such a way that the available diameter matches the diameter of the line. Consequently, the mixers are considerably larger in diameter and are either frontally supported by a narrow annular surface or must be soldered or welded into place so as to achieve a transfer of the polymer melt from and into the line without creating any dead space. If the combination of materials is selected in such a way as to ensure that the mixer expands even more extensively than the hollow object acting as a jacket tube, the mixer will become fixed at spinning and/or operating temperature but will remain capable of being replaced once it has been cooled to room temperature. As the sealing effect is not dependent on the mixer, the jacket tube can also be installed as a simple empty tube instead of as a jacket tube or hollow object into which the mixer has been integrated if the mixing function is only required periodically. Alternatively, and depending on the process in question, other types of mixers with matching jacket tubes can be placed into the socket hole of the nozzle adapter or of the interchangeable component.

The material used to make the nozzle adapter is normally a stainless and, if possible, high-temperature chrome steel, such as X 20 CrNi 17 2 (material no. 1.4057). In this case, the material used to make the hollow object or jacket tube (regardless of whether it is used with or without a mixer) may, for example, be X 6 CrNiTi 18 10 (material no. 1.4541) or X 6 CrNiMoTi 17 12 2 (material no. 1.4571), or a similar material with a correspondingly large thermal expansion coefficient. In each individual case, the fit pairing must be recalculated (using well-known formulas) to account for the selected material combination and the dimensions of the parts, so that the requirement for achieving easy access under cold conditions and a press fit under hot conditions can be met. The material used to make the mixer is only relevant if the fit of the mixer in the jacket tube is to be temperature-dependent.

Although the hollow object can be very short if it does not contain an integrated mixer, its rated length may not be shorter than half its outside diameter. The optimal ratio between diameter and length is 1:1. When mixers are installed, the length of the jacket tube or hollow object is determined by the length of the mixer, with the upper limit depending on the dimensions of the interchangeable component that carries these parts. Preferably, the outside diameter of the hollow object is 1.5 to 2.0 times as large as the largest inside diameter of the melt channels and/or of the melt-conducting bore through the hollow object. This bore is cylindrical if the two melt channels requiring sealing have the same diameter at the transitional level. However, in addition to its sealing function, the hollow object according to the invention is also suitable for making adjustments among various line diameters. In this case, the bore is conically shaped, at least in part, to correspond to the changing diameter.

The jacket tube according to the invention not only eliminates the need for expensive sealing elements, but also easily allows for adjustments to conform to various line diameters, as well as for the rapid replacement of any static mixers.

The application and operation of the invention is explained in greater detail below, using the two drawings for demonstration purposes.

FIG. 1 depicts a section of a permanently mounted spinning beam (1). The nozzle installation space (2) is depicted without a spinning package. The figure only depicts the nozzle adapter (3), which is secured to the spinning beam with screws (4). The hollow object or jacket tube (5), into which a static mixer (6) is installed, is positioned in the socket hole (9) in the adapter (3). The melt channel (7) emerging from the spinning beam (1) is connected to the melt channel (8) in the nozzle adapter (3) through the mixer (6) and is sealed at operating temperature (temperature of the polymer melt) in all directions by the jacket tube (5). The jacket tube (5) can also fulfill the sealing function when it is empty. However, it must be made of a material with a higher thermal expansion coefficient than that of the surrounding nozzle adapter material. The sealing function is achieved because the installed jacket tube (5) is subject to greater expansion at spinning temperatures than the surrounding space in the nozzle adapter (3). Strong surface pressure is generated in both radial and axial directions, thus producing a sealing effect in both radial and axial directions. The nozzle adapter (3), which was installed while cold, can easily be removed while hot and be replaced by another nozzle adapter which is still cold, because the seal between the spinning beam (1) and the adapter (3) is only achieved as a result of the frontal pressure generated when the temperature is increased to operating temperature.

Figure 2:
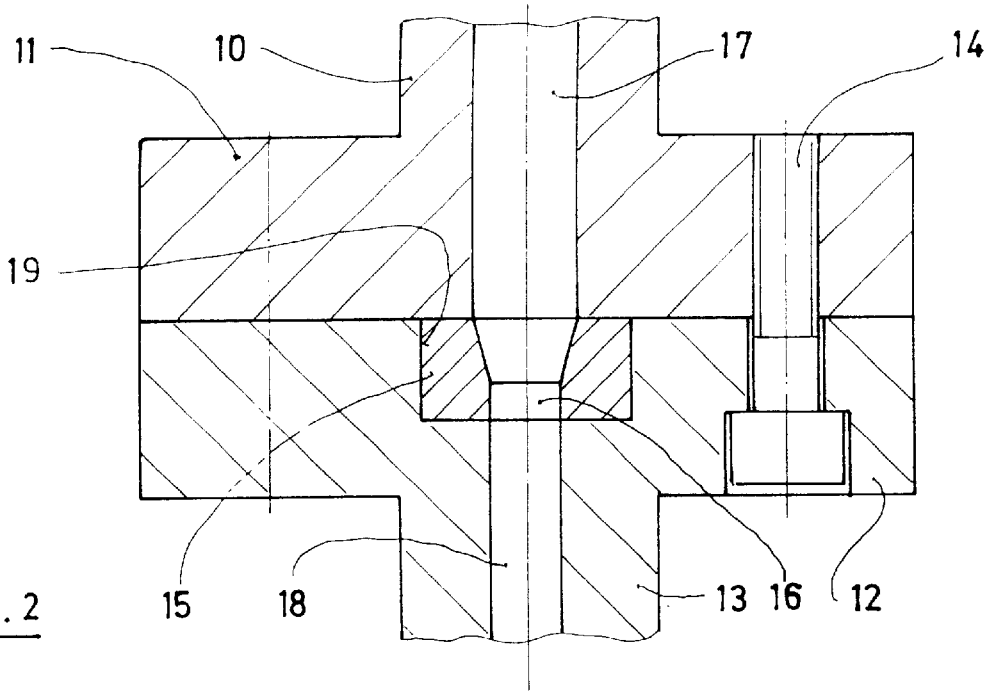
FIG. 2 depicts a general sealing application according to the invention.

FIG. 2 depicts a general sealing application according to the invention. A tube (10), which can also be hot during assembly, has a completely level flange (11), which is connected by screws (14) to the completely level flange (12) of another tube (13), or to that of any other component that is installed while cold. A hollow object or short tube segment (15) with an axial bore (16) is positioned in the socket hole (19) in the flange (12) of the component (13), which is installed while cold. The tube segment (15) connects the tube melt channels (17) and (18) (with the additional function, in this case, of reducing the diameter from one channel the next) and seals them in all directions at operating temperature, provided it consists of a material with a higher thermal expansion coefficient than that of the surrounding material of the flange (12). Naturally, the two melt channels (17) and (18) can also be of identical size; if this is the case, the inside bore (16) of the short tube segment (15) also has the same diameter without any reduction. In any event, the short tube segment (15) has an outside diameter at least 1.5 times to twice the diameter of the large melt channel, and a length corresponding to at least half, but preferably all of its own outside diameter. The wall thickness of the carrier component itself may not be too thin, as the wall must be capable of withstanding the compression pressure generated by the thermal expansion of the tube segment (15) and, if applicable, the pressure exerted by the polymer melt circulating in the melt channels (17) and (18).

What is claimed is:

1. An apparatus through which liquid or molten material flows, the apparatus comprising a) a first component having a first surface and a first channel of diameter $d_1$ in fluid connection with the first surface;

b) a second component having a second surface, a socket hole with a diameter $d_2>d_1$ in fluid connection with the second surface, and a second channel in fluid connection with the socket hole; and c) a sealing element that fits entirely into the socket hole and that has a smooth outer surface and an axial bore, wherein the sealing element has an outer diameter $d_3>d_1$; wherein i) the sealing element is made of a material with a higher thermal expansion coefficient than that of the material of the second component forming the socket hole; and ii) when the first component and the second component are securely affixed together at their first and second surfaces, respectively, such that the first channel, the socket hole, and the second channel are all in fluid connection, and the components are heated, the sealing element expands radially against the socket hole and axially against both the socket hole and the first surface of the first component such that the fluid connection between the first channel and the second channel is sealed.

2. The apparatus of claim 1, wherein the first surface and the second surface are both even and smooth and are completely flush when the first component and the second component are securely affixed together at the first and second surfaces.

3. The apparatus of claim 1 wherein $d_3$ is at least 1.5 times larger than the larger of the diameters of the first and second channels.

4. The apparatus of claim 1 wherein the sealing element is an austenitic steel and the material of the second component forming the socket hole is a high-temperature chrome steel.

5. The sealing element of claim 4 wherein the austenitic steel is X 6 CrNiTi 18 10 or X 6 CrNiMoTi 17 12 2, and the high-temperature chrome steel is X 20 Cr Ni 17 2.

6. The apparatus of claim 1 wherein the axial bore of the sealing element is at least partly conical.

7. The apparatus of claim 1 wherein the second component can be removed from the first component under all temperature conditions.

8. The apparatus of claim 1 wherein the first component is a spinning beam, the second component is a nozzle adapter of a melt spinning system, and the sealing element is a tube.

9. The apparatus of claim 1 wherein a static mixing element is inserted in the axial bore of the sealing element.

10. The apparatus of claim 1 wherein the static mixing element possesses a higher thermal expansion coefficient than the sealing element such that the mixing element is fixed in the sealing element at elevated temperatures.

* * * * *